US006902091B2

(12) United States Patent
Cortigiano, Sr.

(10) Patent No.: US 6,902,091 B2
(45) Date of Patent: Jun. 7, 2005

(54) METHOD AND APPARATUS FOR FEEDING SLIDER-ZIPPER TAPE TO APPLICATION STATION

(75) Inventor: Ronald Cortigiano, Sr., Toccoa, GA (US)

(73) Assignee: Illinois Tool Works Inc., Glenview, IL (US)

( * ) Notice: Subject to any disclaimer, the term of this patent is extended or adjusted under 35 U.S.C. 154(b) by 314 days.

(21) Appl. No.: 10/208,313

(22) Filed: Jul. 31, 2002

(65) Prior Publication Data

US 2003/0079840 A1 May 1, 2003

Related U.S. Application Data

(63) Continuation-in-part of application No. 10/021,230, filed on Oct. 30, 2001, now Pat. No. 6,732,898.

(51) Int. Cl.[7] ..... B65B 9/06; B65B 61/18

(52) U.S. Cl. ..... 226/190; 226/175; 226/194; 156/580; 156/308.4; 53/450

(58) Field of Search ..... 226/175, 179, 226/194, 190; 53/450; 29/417; 156/494, 580, 308.4

(56) References Cited

U.S. PATENT DOCUMENTS 3,853,671 A 12/1974 Ausnit ..... 156/580
3,948,705 A * 4/1976 Ausnit ..... 156/73.4
5,114,057 A * 5/1992 Ishikawa ..... 223/37
5,400,568 A 3/1995 Kanemitsu et al. ..... 53/412
5,782,733 A 7/1998 Yeager ..... 493/213
5,967,512 A * 10/1999 Irsik ..... 271/273
6,327,837 B1 12/2001 Van Erden ..... 53/412
6,350,340 B1 2/2002 Johnson ..... 156/252
6,732,898 B2 * 5/2004 Cortigiano, Sr. ..... 226/190

* cited by examiner

*Primary Examiner*—Kathy Matecki
*Assistant Examiner*—E. Langdon
(74) *Attorney, Agent, or Firm*—Ostrager Chong Flaherty & Broitman P.C.

(57) ABSTRACT

A method and an apparatus for automatically feeding slider-zipper assemblies to a station where the slider-zipper assemblies can be attached to bag material, such as thermoplastic film. The apparatus includes a slider guide having a channel running the length thereof. The channel has a cross section that allows passage therethrough of sliders slidably mounted to a tape of connected slider-zipper assemblies. A tape drive mechanism is located at the outlet of the slider guide. The tape drive mechanism includes a pair of rollers that form a nip therebetween. The zipper flanges of the tape are threaded through the nip. The rollers have respective grooves that form a space for passage of the sliders as the tape is advanced by the rollers. The zipper tape with sliders exits the tape drive mechanism and is drawn into a zipper flange sealing position by a tape transfer assembly comprising a bank of drive rollers having silicone surfaces in contact with the zipper tape. The drive rollers have peripheral grooves that oppose a longitudinal groove in a shelf, the zipper profile being captured between the opposing grooves.

6 Claims, 8 Drawing Sheets

METHOD AND APPARATUS FOR FEEDING SLIDER-ZIPPER TAPE TO APPLICATION STATION

RELATED PATENT APPLICATION

This application is a continuation-in-part application claiming priority from U.S. patent application Ser. No. 10/021,230 filed on Oct. 30, 2001 now U.S. Pat. No. 6,732,898 and entitled "Method and Apparatus for Feeding Slider-Zipper Assemblies".

BACKGROUND OF THE INVENTION

The present invention relates to methods and apparatuses for automated manufacture of a reclosable plastic package having a resealable closure, especially as part of a form, fill and seal process. In particular, the invention relates to methods and apparatuses for manufacturing reclosable plastic packages and bags having a slider-zipper assembly installed in the mouth of the package.

In the use of plastic bags and packages, particularly for foodstuffs, it is important that the bag be hermetically sealed until the purchaser acquires the product, takes it home, and opens the bag or package for the first time. It is then commercially attractive and useful for the consumer that the bag or package be reclosable so that its contents may be protected. Flexible plastic zippers have proven to be excellent for reclosable bags, because they may be manufactured with high-speed equipment and are reliable for repeated reuse.

A typical zipper comprises one fastener strip or member having a groove and attached to one side of the bag mouth, and another fastener strip or member having a rib and attached to the other side of the bag mouth, which rib may interlock into the groove when the sides of the mouth of the bag are pressed together. Alternatively, a fastener strip having a plurality of ribs may be on one side of the bag mouth, while a fastener strip having a plurality of grooves or channels may be on the other side, the ribs locking into the channels when the sides of the mouth of the bag are pressed together. In the latter case, there may be no difference in appearance between the two fastener strips, as the ribs may simply be the intervals between channels on a strip that may lock into another of the same kind. In general, and in short, some form of male/female interengagement is used to join the two sides of the bag mouth together. The fastener strips or members are bonded in some manner to the material from which the bags themselves are manufactured.

In the automated manufacture of plastic reclosable packages or bags, it is known to feed a zipper assembly to a position adjacent a sheet of thermoplastic film and then attach the zipper assembly to the bag by means of heat sealing. The zipper assemblies are attached at spaced intervals along the thermoplastic sheet, one zipper assembly being attached to each section of film respectively corresponding to an individual package or bag. The zipper assembly consists of two interlocking fastener strips that, in the final package, lie inside the mouth of the package. Each fastener strip preferably has a flange that extends toward the product side of the package in a direction transverse to the line of the zipper. In accordance with one known method of feeding zipper assemblies to an automated form, fill and seal machine, the zipper assembly is in the form of a tape that is unwound from a spool for automated feeding. The tape comprises a continuous length of interlocked fastener strips. The continuous tape is feed to a cutting device that cuts the tape at regular lengths to form an individual zipper. Each individual zipper is attached to the thermoplastic film by heat sealing or other suitable means.

Prior to cutting and heat sealing, the zipper assembly must be automatically positioned correctly relative to the thermoplastic film. Moving the zipper assembly into position overlying the thermoplastic film requires a positioning device. Some prior art positioning devices comprise a channel that guides the continuous zipper tape toward its proper position relative to the thermoplastic bag making film. The zipper assembly may be positioned parallel or perpendicular to the direction of movement of the bag making film. Because the fastener strips of a zipper assembly not slider-operated have a constant profile in the lengthwise direction, it is a relatively simple matter to design a linear guide channel having a cross section which matches the profile of the interlocked fastener strips with sufficient clearance to allow the zipper tape to be pushed or pulled through the guide with minimal friction, yet not so great as to allow the zipper tape to skew, twist or move sideways in the guide channel.

Other types of reclosable plastic bags, however, contain a slider that facilitates a consumer opening and re-closing the package by disengaging and re-engaging the two sides of the zipper. However, adding a slider to the zipper assembly requires the design of guide devices different than those used when reclosable packages having zippers without sliders are being manufactured.

In the prior art it is known to feed a continuous tape of interlocked faster strips to a shaping device that crushes the strips at regular intervals in the lengthwise direction to provide restraints or stops for the slider. At the next station, a slider insertion device inserts a respective slider onto each section of zipper tape between successive slider end stops. The slider can be slid along the zipper tape between a leftmost position in abutment with the left-hand slider end stop and a rightmost position in abutment with the right-hand slider end stop. The resulting tape of slider-zipper assemblies must be fed automatically to a station where each slider-zipper assembly will be cut off the end of the tape and attached to a respective section of the thermoplastic bag material, e.g., by heat sealing, such sections of thermoplastic bag material being spaced at package intervals.

There is a need for a method and an apparatus for guiding a tape of slider-zipper assemblies to a desired position overlying the bag making film during automated feeding of the slider-zipper assemblies. The apparatus must take into account that the sliders intermittently placed along the continuous zipper tape have width and height dimensions greater than the corresponding dimensions of the interlocked profiles of the zipper halves.

BRIEF DESCRIPTION OF THE INVENTION

The present invention is directed to a method and an apparatus for automatically feeding slider-zipper assemblies to a station where the slider-zipper assemblies can be sealed to thermoplastic bag making film. For example, the sealing station may be combined with a vertical form-fill-seal (FFS) machine, in which case the slider-zipper assemblies are applied to the film in a transverse direction, i.e., transverse to the running direction of the bag making film.

One aspect of the invention is an apparatus comprising a tape feed assembly, a tape transfer assembly, and means for coupling the tape feed assembly to the tape transfer assembly. The tape feed assembly comprises a pair of rollers arranged to form a nip therebetween. Each roller has a respective peripheral groove, the peripheral grooves being aligned. Opposing portions of the peripheral grooves form a passageway designed to allow passage of a slider when associated flanges of a zipper tape carrying the slider are passed through the nip. The tape transfer assembly comprises a plurality of drive rollers and a shelf having a longitudinal groove. Each drive roller has a respective peripheral groove aligned with the longitudinal groove in the shelf. Opposing portions of each drive roller peripheral groove and the longitudinal groove form passageways designed to allow passage of interlocked parts of the zipper tape.

Another aspect of the invention is an apparatus comprising: a fixed support structure; a carriage; first and second guide shafts connected to the carriage, the first and second guide shafts having mutually parallel axes; first and second bearings in which the first and second guide shafts are respectively supported for vertical translation, the first and second bearings being mounted to the support structure; a cylinder mounted to the support structure, the cylinder comprising a piston coupled to the carriage, the piston having an axis parallel to the axes of the first and second guide shafts; a plurality of drive rollers rotatably mounted to the carriage; and a shelf mounted to the support structure, disposed in a horizontal plane and comprising a longitudinal groove. Each drive roller has a respective peripheral groove aligned with the longitudinal groove of the shelf. The carriage is displaceable in a vertical direction by actuation of the cylinder.

A further aspect of the invention is an apparatus comprising: a fixed support structure; a carriage; means for displacing the carriage in a vertical direction; a plurality of drive rollers rotatably mounted to the carriage; and a shelf mounted to the support structure, disposed in a horizontal plane and comprising a longitudinal groove. Each drive roller has a respective peripheral groove aligned with the longitudinal groove of the shelf.

Yet another aspect of the invention is a system for advancing a zipper tape with sliders inserted thereon at spaced intervals, the zipper tape comprising first and second profiled closure members and first and second extensions flanges respectively connected to the first and second closure elements and extending generally in the same direction, the first and second closure elements being interlocked. The tape advancement system comprises a pair of rollers forming a nip therebetween, each roller having a respective annular groove formed on its periphery. The grooves in the rollers are aligned with each other. Opposing portions of the annular grooves form a passageway designed to allow passage of a slider when the zipper flanges of the zipper tape are passed through the nip during zipper tape advancement.

Another aspect of the invention is an apparatus comprising a support structure, first and second sets of bearings supported by the support structure, first and second rollers rotatably supported by the first and second sets of bearings respectively and forming a nip therebetween, the first and second rollers having first and second annular grooves respectively formed on their peripheries. The annular grooves are aligned with each other so that opposing portions of the groove form a passageway having portions of the nip on opposing sides thereof.

Other aspects of the invention are disclosed and claimed below.

DETAILED DESCRIPTION OF THE INVENTION

The present invention can be utilized in conjunction with many different methods of packaging product in a reclosable plastic package or bag. In particular, the invention has application in automated lines or machines which form a package, fill it with product, and then seal the product inside the package using any one of the known form-fill-seal (FFS) methods, such as HFFS (horizontal form-fill-seal), VFFS (vertical form-fill-seal) with the zipper applied in either the machine or transverse direction, or HFVFS (horizontal form/vertical fill-seal). In general, the conventional methods of packaging product in reclosable packaging using a form, fill and seal automated process comprise the following steps: attaching one zipper assembly to the bag making film for each package length interval; forming the bag making film into successive packages, each package having a respective zipper assembly; filling each package with product; sealing each filled package, and then separating the filled package from the bag making film. The zipper assembly can be oriented in either a machine direction or a transverse (cross) direction when attached to the bag making film.

In a typical form-fill-seal operation, a continuous supply of thin packaging or bag making film is paid off of a supply reel by a suitable mechanism. For example, the FFS machine may be provided with feed drive rollers for pulling the film through the FFS machine. For each length of bag making film corresponding to an individual package, a zipper assembly is attached to the film. The zipper may be laid directly on the film, but preferably is fed laterally across the upper surface of the film at right angles to the longitudinal edges of the film or, in other words, at right angles to the longitudinal formation axis of the film. The zipper are cut off from the end of a zipper tape that is paid out from a zipper tape supply reel and guided to a sealing and cutting station, where an individual zipper is cut and sealed to the bag making film. The length of the zipper strip will be less than one-half of the film width. A typical zipper comprises a pair of zipper flanges, only one of which is sealed to the film during the initial sealing operation. The lateral portions of the film beyond the ends of the attached zipper are sufficiently long so that they can eventually be folded over and sealed to the other zipper flange.

The foregoing automated process becomes more complex when zipper assemblies with sliders are used as the reclosable plastic fastening means. The machinery for feeding the slider-zipper assemblies to the desired position overlying the thermoplastic film must take account of the different profile and larger dimensions of the slider as compared to the profile and dimensions of the interlocked fastening members of the zipper.

Figure 1:
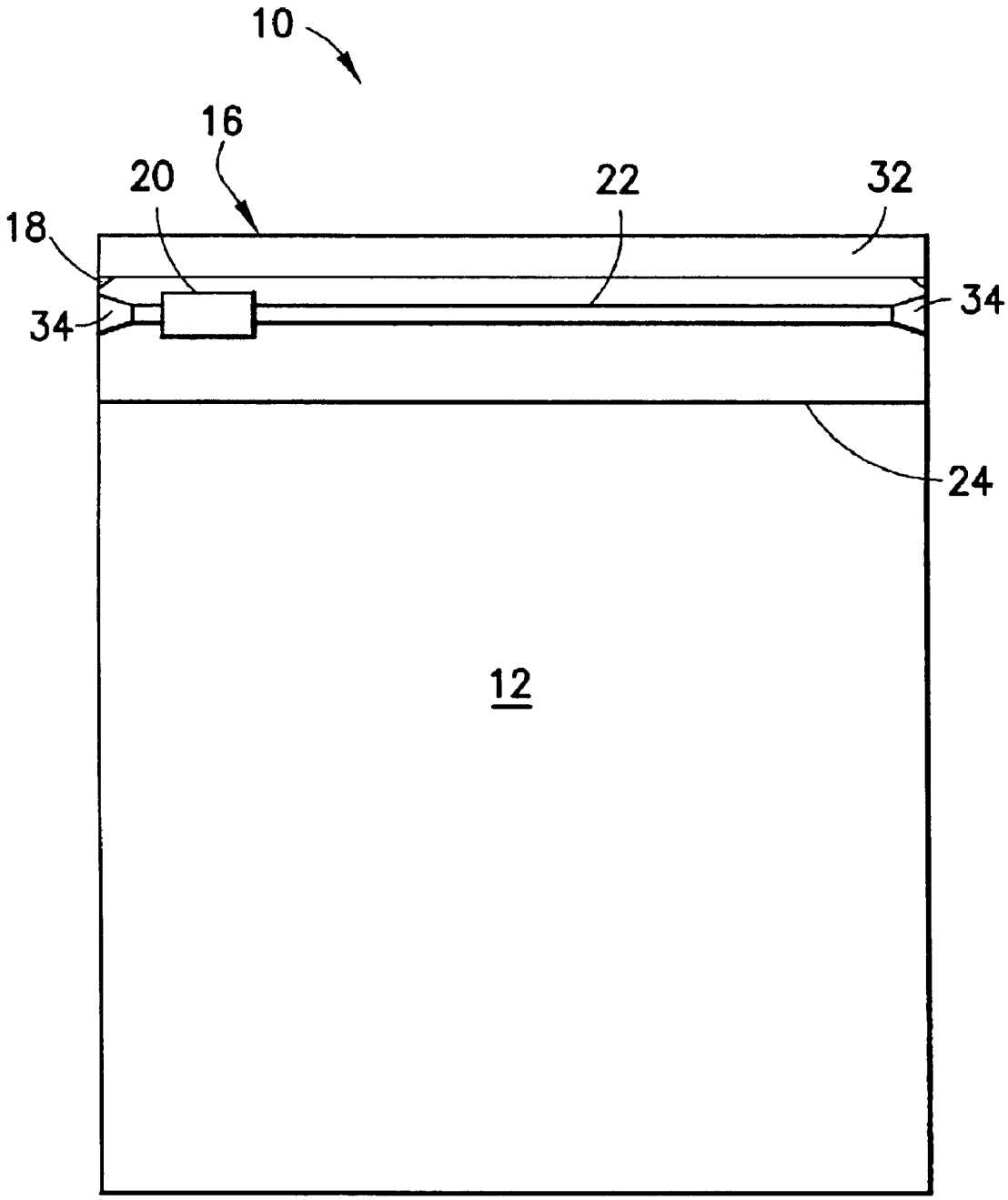
FIG. 1 is a drawing showing a front view of a conventional reclosable package having a slider-zipper assembly installed in the mouth of the package.

Reference will now be made to the drawings in which similar elements in different drawings bear the same reference numerals. FIG. 1 depicts a reclosable package 10 comprising a receptacle with a mouth at the top, the receptacle being formed by a front wall 12 and a rear wall (not shown) that is opposite to the front wall. The front and rear walls are typically formed from clear thermoplastic film heat sealed as necessary to form hermetically sealed junctures for the various portions of the package, e.g., along the sides if folded along the bottom or along a central seam and along the bottom if folded along the sides. A zipper 22 comprising a pair of fastener strips having respective interlockable members is provided in the mouth of the receptacle, attached to the front wall 12 and rear wall. A slider 20 is provided on the zipper to facilitate its opening and closing. FIG. 1 shows the slider 20 in a position corresponding to closure of the zipper 22. Moving the slider 20 toward the right-hand side would disengage the interlockable members of the zipper and moving the slider back to the closed position shown in FIG. 1 brings the interlockable members of the zipper into full engagement once again. For proper functioning, the interlockable members have spot seals or ultrasonic stomps 34 at the ends of the zipper strips. These seals ensure the zipper strips will not come apart during use and provide end stops for stopping the slider 20.

Prior to opening of the package by the consumer, the slider-zipper assembly may be covered on the consumer side by an enclosed header 16 that is hermetically sealed. The sealed header 16, which provides a tamper-evident feature, comprises front and rear panels that may be integrally formed with or heat sealed to the front and rear walls, respectively, of the receptacle. The numeral 32 in FIG. 1 designates a hard seal, i.e., a seal that is not intended to be broken, at the top of the header. Alternatively, the opposed header panels may be formed by folding a piece of film and attaching the ends to the walls of the receptacle. The sealed header 16 preferably has respective tear notches 18 formed on each side edge of the header, where the consumer can initiate tearing off of the sealed header from the package.

It should be appreciated that the front wall of the header 32 and the front wall 12 of the receptacle are shown in FIG. 1 as being made of relatively transparent thermoplastic material. Therefore, the slider-zipper assembly is visible through the clear walls and has not been depicted as hidden.

Figure 2:
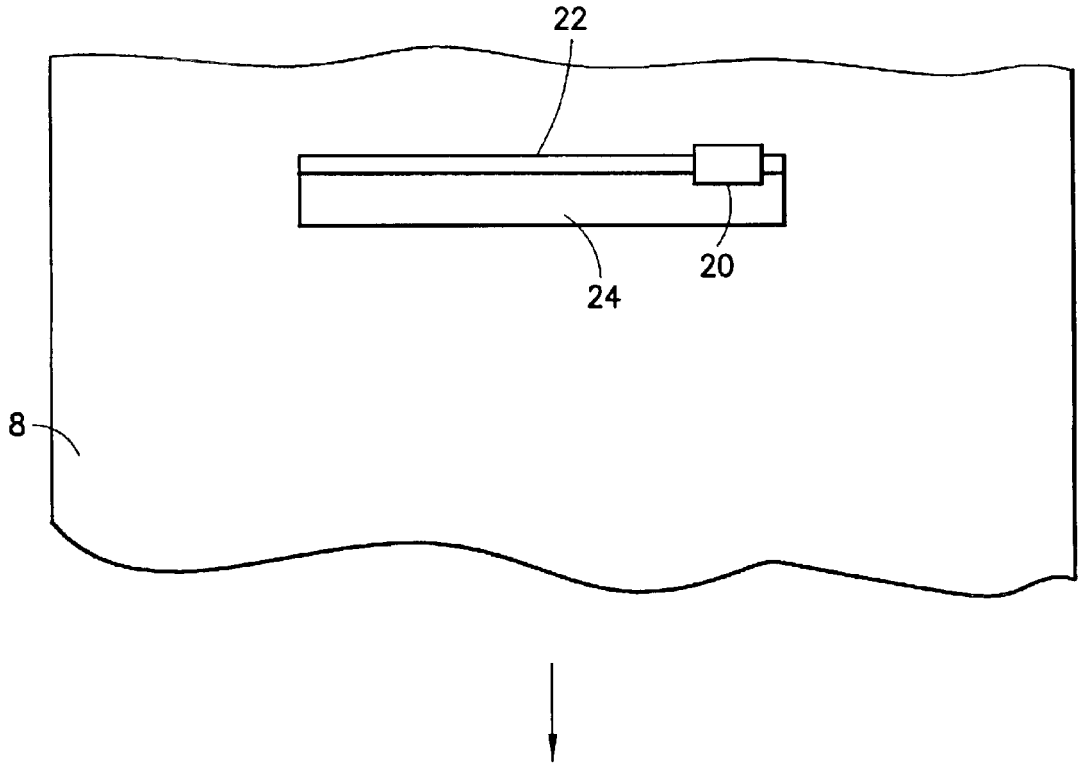
FIG. 2 is a drawing showing a fragmentary top view of a slide-zipper assembly attached to a bag making film and oriented in a transverse direction.

FIG. 2 depicts thermoplastic bag making film 8 with a slider-zipper assembly heat sealed thereon. The slider-zipper assembly comprises a slider 20 and a zipper 22. Preferably the slider-zipper assembly is cut off from the end of a tape or chain of such assemblies and heat sealed to the thermoplastic film using automated equipment. The present invention is directed to providing automated means for guiding and feeding a zipper tape with inserted sliders from a slider insertion machine or from any other source, e.g., a reel, of zipper tape pre-loaded with sliders to a zipper application station.

Figure 4:
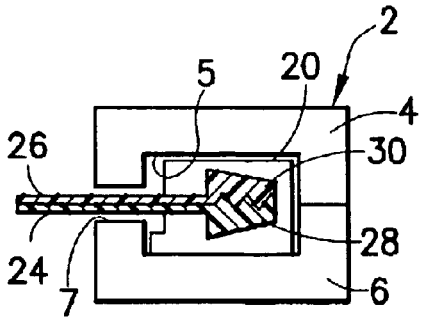
FIG. 4 is a drawing showing a partially sectioned end view of a slider-zipper assembly lying partly within a slider guide comprising upper and lower slider guides.

As best seen in FIG. 4, the zippers are of the type comprising first and second zipper parts or fastener strips. The first fastener strip comprises a first zipper flange 24 and a first interlockable profiled closure member 28, and the second fastener strip comprises a second zipper flange 26 and a second interlockable profiled closure member 30. The first and second interlockable members can be mutually engaged to close the zipper and disengaged to open the zipper. In the exemplary zipper disclosed herein, the closure members 28 and 30, when engaged, form an A-shaped zipper profile. Only zipper flange 24 is visible in FIGS. 1 and 2, with zipper flange 26 (the flange attached to the film in FIG. 2) being hidden behind zipper flange 24. The flange 26 is attached, e.g., by heat sealing, to the underlying thermoplastic bag making film 8, which may take the form of a thin transparent film of thermoplastic material. For example, in the case of a VFFS machine, the bag making film will be wrapped around a filling tube (not shown) by a forming collar (not shown) and a longitudinal fin seal will be made by a pair of vertical seal bars (not shown). [The general arrangement of a filling tube and forming collar with associated vertical seal bars is well known and shown, for example, in U.S. Pat. Nos. 6,178,722 and 6,327,837.] Then the formed tube of film will be cross sealed to form a bottom seal. The bottom-sealed film is then filled with product through the open top via the filling tube. Following filling, the top of the filled package is cross sealed at an elevation above the zipper line, thus forming the enclosed header. This cross seal forms both the top seal of the filled package and the bottom seal of the next-to-be-filled package. At the same time the area of the cross seal is cut to separate the filled package from the next-to-be-filled package. In a concurrent operation, the zipper flange 24 will be sealed to the film at an elevation below the top seal.

Figure 5:
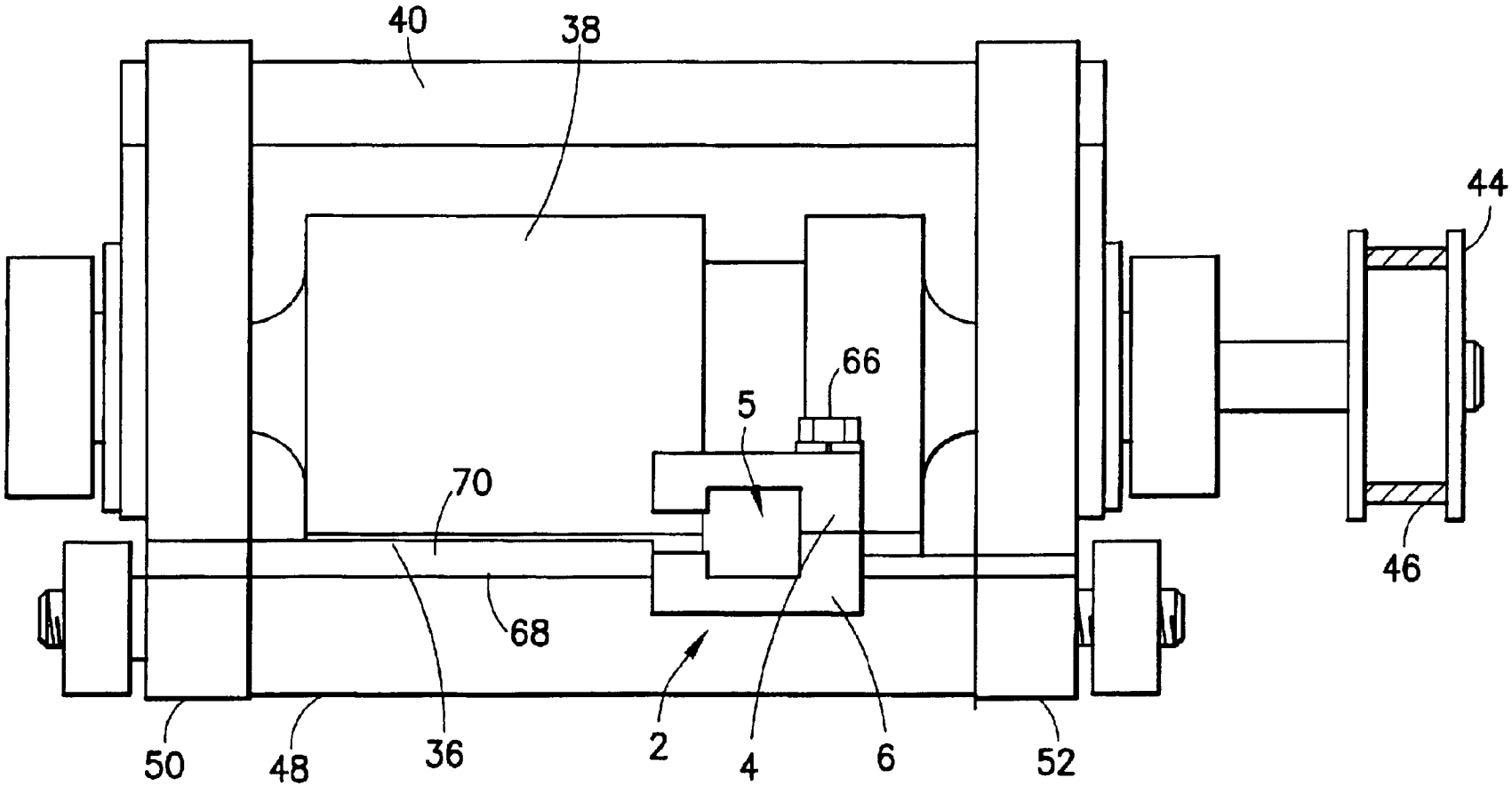
FIG. 5 is a drawing showing a front view of part of a slider-zipper tape drive assembly in accordance with one embodiment of the invention.
Figure 6:
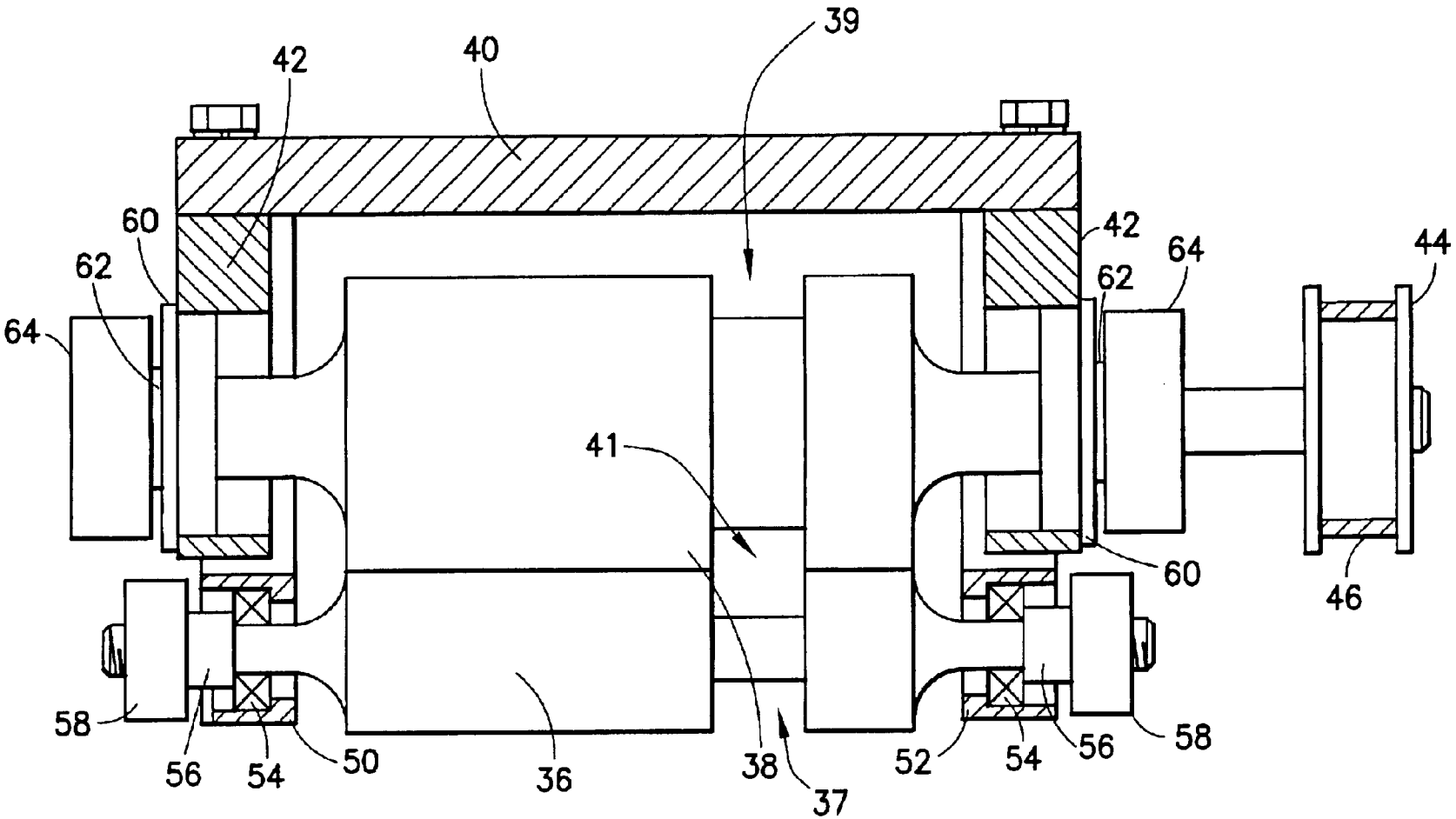
FIG. 6 is a drawing showing a sectional view of the slider-zipper tape drive assembly shown in FIG. 5.
Figure 7:
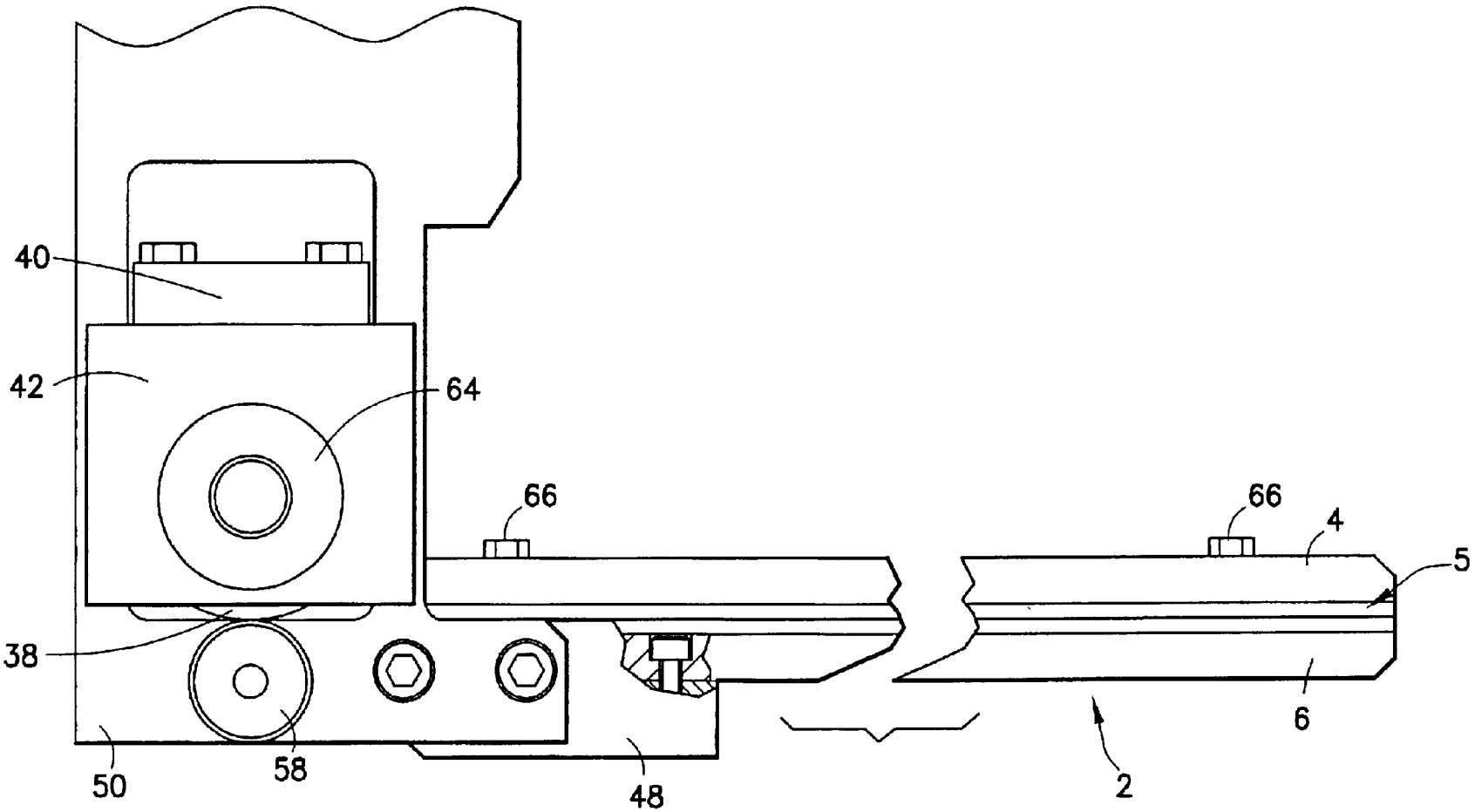
FIG. 7 is a drawing showing a side view of the slider-zipper tape drive assembly shown in FIG. 5.

In accordance with one embodiment of the invention, the slider-zipper assembly arrives at the position shown in FIG. 2 via the slider-zipper tape drive assembly shown in FIGS. 5–7. This tape drive assembly incorporates the slider guide 2 depicted in FIGS. 3 and 4. The slider-zipper assemblies are supplied to the automated package manufacturing line in the form of a continuous tape, a part of which is visible in FIG. 3. Initially, two continuous fastener strips are formed by a well-known extrusion process. These fastener strips have interlockable members 28, 30 (see FIG. 4) that form a zipper tape when the members are interlocked. The resulting zipper tape is then continuously fed to a shaper (not shown) that crushes or fuses the interlocked members at regularly spaced intervals to form end stops or restraints 34 (see FIG. 3) for the sliders 20. This crushing or fusing also ensures that the zipper halves (i.e., fastener strips) will not come apart during use.

After shaping, the tape is advanced to a slider insertion device (not shown) that pushes a respective slider 20 onto each segment of the interlocked members 28, 30 lying between successive end stops 34, the slider being clipped on the zipper profiles. The resulting zipper tape with sliders passes through the slider-zipper tape drive assembly shown in FIGS. 5–7, being intermittently advanced by the tape drive assembly to a tape transfer assembly, which will be described in detail later. Alternatively, the zipper tape can be stomped to form end stops, pre-loaded with sliders and wound on a spool at a different location. The spool is then transported to the zipper application site for application of zippers to bag making film at a later time.

Figure 3:
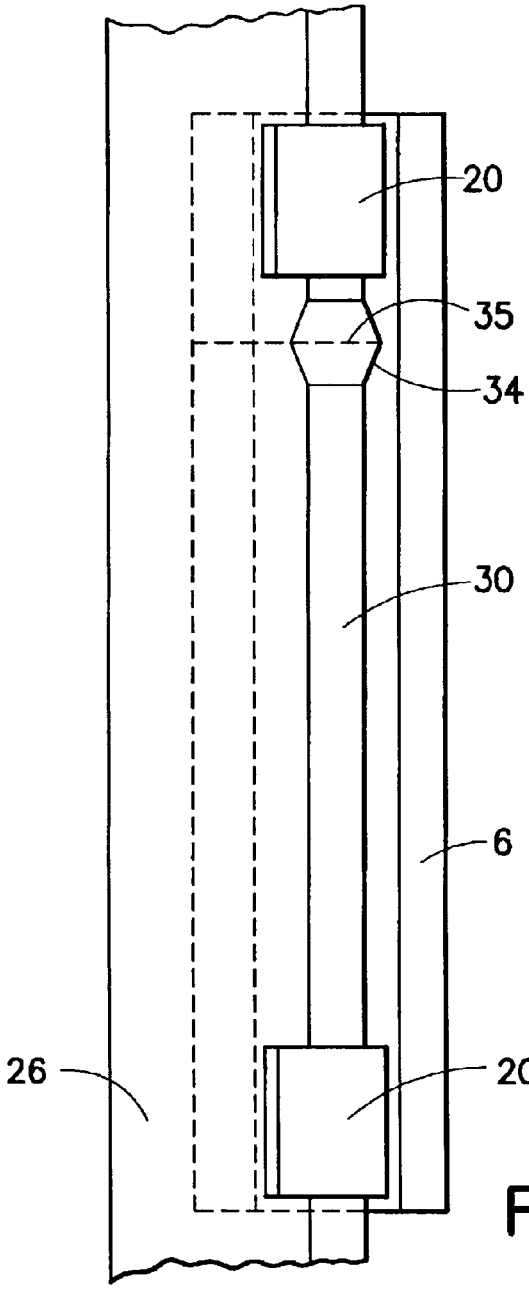
FIG. 3 is a drawing showing a fragmentary top view of a slider-zipper assembly lying partly within a slider guide comprising upper and lower slider guides. The upper slider guide has been removed to reveal the sliders and a portion of the zipper tape that lie within the slider guide channel.

Referring to FIGS. 3 and 4, the slider guide 2 has a generally C-shaped cross section and comprises an upper slider guide 4 and a lower slider guide 6 that are fastened together by a plurality of fasteners. The upper and lower slider guides, when fastened together, form a channel 5. The opposing faces of the distal ends of the upper and lower slider guides form an opening 7 in the side of the slider guide that communicates with the channel 5. The channel 5 and opening 7 both run the length of the slider guide 2. The channel 5 has a cross section that allows passage of successive sliders 20 slidably mounted to a sequence of connected slider-zipper assemblies. Sufficient clearance is provided that the sliders move freely along the channel without jamming. Also the opening 7 is disposed and sized to allow portions of the mutually opposing zipper flanges 24, 26 to penetrate and protrude out of the opening 7, as seen in FIG. 4, with sufficient clearance that the flanges can advance freely in the slider guide 2. As best seen in FIG. 3, the slider guide preferably has a length that ensures at least one slider will be located inside the guide channel at all times during the tape feeding operation. Preferably the slider guide is sufficiently long to encompass two sliders 20 when the tape is in certain positions relative to the guide, such as the relative position shown in FIG. 3. The inlet end of the slider guide 2 preferably has chamfered internal surfaces to facilitate entry of each slider into the channel 5.

FIG. 3 shows an uncut tape of connected slider-zipper assemblies occupying the channel inside the slider guide. At regular intervals, the tape of slider-zipper assemblies is advanced a predetermined distance by the drive mechanism (to be described in detail below with reference to FIGS. 5–7). The tape of connected slider-zipper assemblies is advanced through the slider guide until the terminal section of the zipper tape reaches the desired application position overlying the bag making film. The slider-zipper assembly at the end of the tape is then cut to separate this assembly from the tape. At the same time the bottom zipper flange of the separated assembly is heat sealed to the bag making film. Although the cutting is performed outside of the slider guide, for the sake of illustration, the line where the slider-zipper assembly tape is cut has been indicated by a dashed line designated by numeral 35 in FIG. 3. The cut line generally bisects the crushed or fused zipper regions. These crushed regions, when cut, form respective slider end stops at adjacent ends of successive zipper lengths. The cutting and sealing operations may be performed using automated devices that are not part of the instant invention, and so will not be described in detail herein.

The tape of connected slider-zipper assemblies is pulled through slider guide by the tape drive mechanism depicted in FIGS. 5–7. The tape drive mechanism comprises an idler roller 36 and a nip roller 38 having roller faces that meet squarely to form a nip. The zipper flanges of the tape segment exiting the slider guide are threaded through the nip. The nip roller 38 is rotatably supported by respective flanged bearings 60 mounted to an adjustment plate 40 by means of respective bearing housings 42 at opposite ends of the nip roller 38. The means for adjusting the vertical position of the adjustment plate 40 are not shown. The nip roller 38 is held in position by a pair of spacers 62 and threaded set collars 64. A gearbelt pulley 44 is mounted to the end of the shaft of the nip roller. The pulley is driven by a gearbelt 46 (shown in section in FIGS. 5 and 6), causing the nip roller 38 to rotate. A programmable controller (not shown) controls a servomotor (also not shown), which in turn drives the pulley 44, causing the nip roller to rotate to the extent needed to feed the tape one zipper increment. The pressure exerted by the nip roller 38 on the idler roller 36 in turn causes the idler roller 36 to rotate in the opposite direction. The idler roller 36 is rotatably supported at its ends by respective bearings 54 seated in mounting plates 50 and 52 respectively. The idler roller 36 is held in position by a pair of spacers 56 and threaded set collars 58.

As previously disclosed, the flanges 24 and 26 penetrate and protrude out of the opening 7 formed in the side of the slider guide. When the nip roller is rotated, the friction and compression caused by the surface of the nip roller in contact with the zipper flanges pushes the zipper flanges through the nip. At the same time, the tape transfer assembly shown in FIGS. 8 and 9 pulls the zipper tape forward, as will be described in detail below. The nip roller remains stationary while the slider-zipper assembly at the end of the tape is sealed to the bag making film and cut off. Then the bag making film is indexed in the machine direction one package length and the zipper tape with sliders inserted thereon is indexed in the transverse direction one zipper length, following which the sealing and cutting operations for application of the next slider-zipper assembly are repeated.

In accordance with the preferred embodiment, the idler roller 36 has an annular groove 37 and the nip roller 38 has an annular groove 39, best seen in FIG. 6, which shows the slider guide removed. The groove 37 and 39 preferably are equal in width and are aligned to form a space 41 which is shaped and sized to allow passage therethrough of sliders 20. During tape advancement, one or more sliders 20 inside the slider guide 2 are guided by the internal surfaces forming channel 5. These channel surfaces limit the degree to which the sliders can turn about the longitudinal axis of the channel or any axis perpendicular to the longitudinal axis. The result is that the slider guide maintains each slider in a suitable orientation as it exits the slider guide and enters the tape drive mechanism. Each successive slider exits the slider guide 2 and then passes through space 41 formed by grooves 37 and 39 in the rollers. The slider guide ensures that the tape is in the proper position for passage through the tape drive mechanism. The walls of grooves 37 and 39 also serve to guide each slider as it passes through space 41.

The slider tape drive assembly depicted in FIG. 6 further comprises a guide plate 48 which is positioned forward of the idler roller 36. The lower slider guide 6 is attached to the guide plate 48 by means of fasteners (not shown). The upper slider guide 4 is in turn fastened to the lower slider guide 4 by fasteners 66, as previously described. The guide plate 48 has a beveled surface 68 and a generally horizontal surface 70. The surface 70 guides the zipper flanges toward the roller nip during tape advancement.

Figure 8:
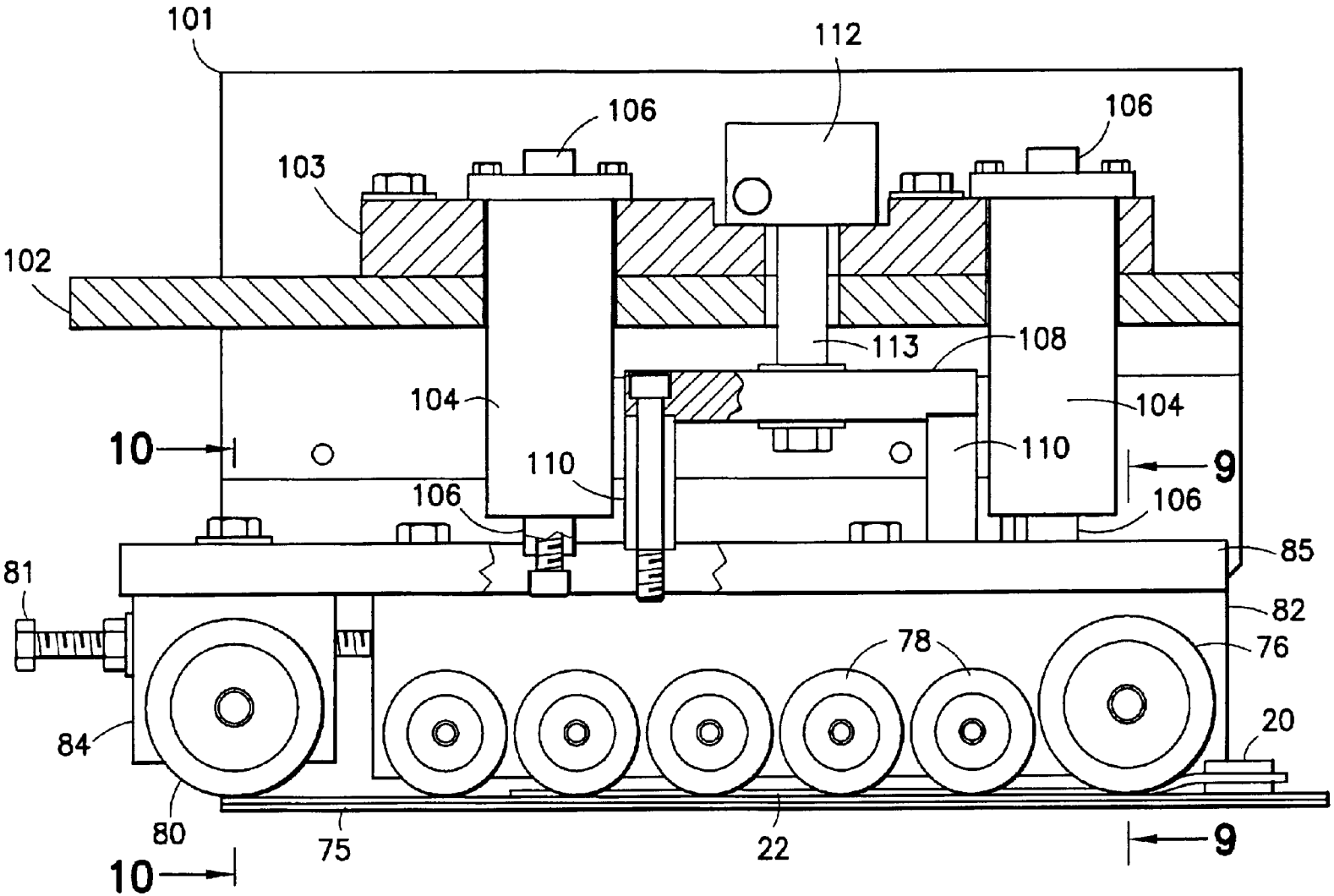
FIG. 8 is a drawing showing a front view of a zipper tape transfer assembly that receives the slider-zipper assembly from the tape drive assembly depicted in FIGS. 5–7.
Figure 9:
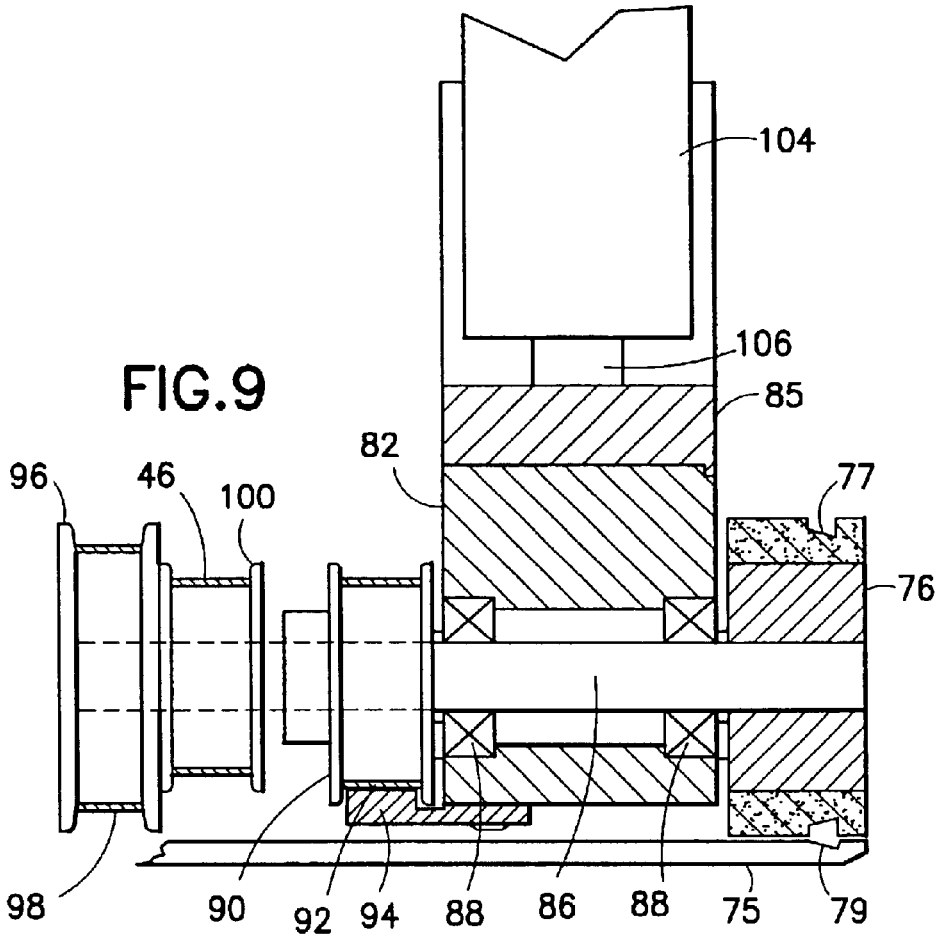
FIG. 9 is a drawing showing a sectional view of the zipper tape transfer assembly shown in FIG. 8, the section being taken along line 9—9 indicated in FIG. 8.

The zipper tape with sliders is advanced from the tape drive assembly to the tape transfer assembly shown in FIGS. 8 and 9. In the front view presented in FIG. 8, the terminal end of the zipper tape is shown in a position between a bank of drive roller assemblies 76, 78, 80 and a fixed shelf 75. The slider 20 of the terminal zipper length sits atop the shelf 75 at a position to the right of the large drive roller 76. The slider cannot pass under the drive rollers. It should be appreciated that the zipper tape extends in the right-hand direction, where it passes through the tape drive assembly. The zipper tape enters the tape transfer assembly from right to left in FIG. 8. In the position shown in FIG. 8, the zipper tape is cut and the cut zipper length is sealed to bag making film that extends in a plane perpendicular to the sheet and passes directly below the shelf 75. The cutting and sealing mechanisms are not shown.

As seen in FIG. 9, the shelf has a V-shaped longitudinal groove 79, while the large drive roller assembly 76 has a circumferential groove 77 with a generally trapezoidal profile. Each of small drive rollers 78 has a similar circumferential groove. These circumferential grooves on the drive roller assemblies are generally aligned with the longitudinal groove 79 of the shelf 75. At the nip where each drive roller nearly contacts the shelf 75, the peripheral grooves 77 and the longitudinal groove 79 form respective passageways for the A-shaped zipper profile. Although not shown in FIG. 9, the flanges of the zipper extend rightward, through the gap between the shelf and roller 76 and beyond the edge of the shelf, where the bottom flange will be sealed to the bag making film.

Still referring to FIG. 9, the drive roller assembly 76 comprises a metal core surrounded by an annular ring made of silicone. The circumferential groove is formed in the annular ring of silicone. The other drive roller assemblies (i.e., items 78 and 80) have a similar construction. The metal core of the drive roller 76 is mounted to one end of a horizontal shaft 86. The shaft 86 is rotatably supported by a pair of bearings 88. The bearings 88 are mounted in a pulley mounting plate 82. The other drive assemblies are also mounted to the end of respective horizontal shafts rotatably supported by respective sets of bearings mounted in the pulley mounting plate 82. Shaft 86, however, differs from the other shafts in that shaft 86 is longer and carries, on its opposite end, a gearbelt pulley 96 that is coupled to the servomotor by a gearbelt 98 and a gearbelt pulley 100 that is coupled to the gearbelt pulley 44 of the tape drive assembly (see FIG. 5) by a gearbelt 46. Thus, the servomotor (not shown) drives the rotation of shaft 86 and drive roller assembly 76 mounted thereon. The rotation of shaft 86 in turn drives the rotation of nip roller 38 (shown in FIG. 5) of the tape drive assembly.

The rotation of shaft 86 also drives the rotation of the other drive roller assemblies 78 and 80 of the tape transfer assembly. As seen in FIG. 9, a gearbelt pulley 90 is mounted on shaft 86. The gearbelt pulley 90 and the drive roller assembly 76 are mounted on shaft 86 on opposite sides of the pulley mounting plate 82. Similarly, the other shafts, on which the other drive roller assemblies 78 and 80 are mounted, also have gearbelt pulleys aligned with gearbelt pulley 90 and coupled to gearbelt pulley 90 by means of a gearbelt 92. The gearbelt 92 is retained against the gearbelt pulley 90 by a drive belt retainer 94. Moreover, each gearbelt pulley driven by gearbelt 92 also has a respective drive belt retainer (not shown).

Figure 10:
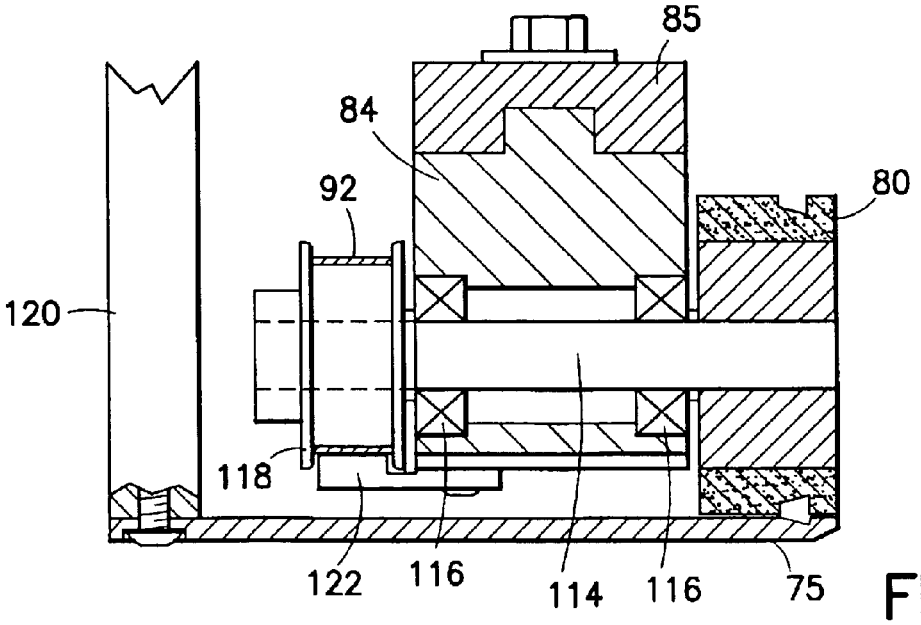
FIG. 10 is a drawing showing another sectional view of the zipper tape transfer assembly shown in FIG. 8, this section being taken along line 10—10 indicated in FIG. 8.

FIG. 10 shows a similar arrangement for drive roller assembly 80, which is mounted to one end of a shaft 114 rotatably supported by bearings 116. A gearbelt pulley 118 is mounted to the other end of the shaft 114. Pulley 118 is coupled to pulley 90 (shown in FIG. 9) by the gearbelt 92, which is held against pulley 118 by a drive belt retainer 122. As seen in FIG. 10, the shelf 75 is fastened to a shelf mounting plate 120 and extends in cantilevered fashion to a location underneath the bank of drive roller assemblies. Although not shown in FIG. 10, the shelf mounting plate 120 is a vertical plate that overlaps and is fastened to a vertical bearing plate 101 (shown in FIG. 8). The bearing plate 101 and the shelf mounting plate 120 form parts of a fixed support structure.

Referring now to FIG. 8, the position of drive roller assembly 80 is adjustable along the axis of a screw 81. More specifically, the drive roller assembly 80 is rotatably mounted to adjustment pulley mount 84, which translates along the screw axis as screw 81 is turned. This facilitates the installation and tightening of gearbelt 92. The gearbelt 92 ensures that the peripheral points of contact with the zipper of all drive roller assemblies move at the same tangential velocity.

As previously mentioned, the peripheral surface of each drive roller is made of silicone to prevent slippage of the plastic zipper tape during transfer of the zipper tape in a direction transverse to the running direction of the bag making film. The non-slipping contact of the periphery and groove of the drive rollers with the zipper tape during roller rotation in a clockwise direction (as seen in FIG. 8) pulls the zipper tape from right to left in FIG. 8. As previously described, the tape transfer assembly shown in FIGS. 8 and 9 applies force to the terminal section of the zipper tape while the tape drive assembly shown in FIGS. 5–7 applies force to a trailing intermediate section of the zipper tape, these assemblies working concurrently and being driven by the same servomotor (via gearbelt 46 seen in FIGS. 5 and 9). Transverse transfer of the zipper tape is stopped before the slider 20 contacts drive roller assembly 76. In this position, the zipper tape is cut and sealed to the bag making film.

After each slider-zipper assembly has been attached to the bag making film along a line transverse to the running direction of the film, the film with slider-zipper assembly must be advanced by one package length. With reference to the drawings, the bag making film will be advanced in a direction directed out of the page in FIG. 8 and from left to right in FIG. 9. However, as seen in FIG. 9, the opposing grooves 77 and 79 form a passageway for receiving the A-shaped zipper profile while the gap to the right, through which the zipper flanges project, is too narrow to allow the A-shaped zipper profile to pass through during film advancement. This problem is solved by providing a tape transfer assembly in which the drive roller assemblies can be lifted upward and away from the stationary shelf 75.

Referring to FIG. 8, the drive roller assemblies are rendered vertically retractable by mounting them to a vertically displaceable mounting plate 85. More specifically, the pulley mounting plate 82, which supports the drive roller assemblies 76 and 78 directly and the drive roller assembly 80 indirectly (via screw 81), is fastened to the mounting plate 85. The mounting plate 85 is fastened to the ends of a pair of guide shafts 106, which are in turn respectively supported for vertical displacement by a pair of flanged mount bearings 104. The flanged mount bearings 104 are fastened to a horizontal mounting plate 103, which sits on and is fastened to another horizontal mounting plate 102. The mounting plates 102, 103 also form part of the aforementioned fixed support structure. The horizontal mounting plate 102 spans and is supported by a pair of vertical bearing plates, only one of which is shown and designated 101 in FIG. 8. The bearing plate 101 depicted in FIG. 8 has the previously mentioned shelf mounting plate (item 120 in FIG. 10) fastened thereto. The mounting plates 102, 103, and 120 and the bearing plates 101 form parts of the fixed support structure. The flanged mount bearings 104 extend downward through respective sets of aligned apertures in the mounting plates 102 and 103. The axes of the guide shafts 106 are mutually parallel and directed vertically. This arrangement allows the entire carriage comprising the mounting plate 85, the pulley mounting plate 82, the drive roller assemblies 76, 78, 80, the gearbelt pulleys, and associated shafts, bearings, and belt retainers to be displaced vertically. Each of the drive rollers is separated from the shelf by a respective first gap when the carriage is in a fully extended position, this first gap being less than the width of the zipper profile, e.g., 0.020 inch. Each drive roller is separated from the shelf by a respective second gap when the carriage is in a fully retracted position, this second gap being greater than the zipper profile width, thereby providing sufficient clearance for the zipper profile to exit the tape transfer assembly when the bag making film, to which the zipper is now sealed, is advanced.

The force for lifting the carriage is provided by an air cylinder 112 having a piston 113, the end of which is fastened to a pressure plate 108. Alternatively, a hydraulic cylinder could be used. The pressure plate 108 is fastened to the mounting plate 85, the distance between plates 85 and 108 being determined by a plurality of stand-offs 110. The air cylinder 112 is mounted to the mounting plate 103. Aligned apertures in the mounting plates 102 and 103 allow passage of the piston 113. Actuation of the air cylinder is controlled by the same programmable controller that controls the servomotor, which drives roller rotation in the tape drive assembly and the tape transfer assembly. The programmable controller causes the drive roller assemblies to be lifted just prior to advancement of the bag making film, which is typically under the control of a separate programmable controller.

Although FIG. 9 does not show the zipper, the person skilled in the art will readily understand that the zipper profile will be captured between grooves 77 and 79 and the zipper flanges will extend to the right, through the gap between drive roller assembly 76 and shelf 75. After the bottom zipper flange has been sealed to the top of the bag making film, which passes under shelf 75, the carriage is lifted and then the bag making film is advanced to the right, as seen in FIG. 9. When the drive roller assembly 76 is raised, groove 77 no longer interferes with rightward movement of the zipper profile as the bag making film (which the zipper is now attached to) moves to the right. Also, the groove 79 in shelf 75 is formed with a surface that is inclined to facilitate the zipper profile leaving groove 79 without the lower lip of the zipper profile catching in the groove. After the bag making film has been advanced one package length, the carriage is lowered and the next zipper length is pulled into the flange sealing position by the drive roller assemblies.

A person skilled in the art of machinery design will readily appreciate that displacing means other than a cylinder can be used to vertically displace the drive roller carriage. Any other known mechanical displacement means can be used. For the sake of illustration, such mechanical displacement devices include rack and pinion arrangements, rotation of the pinion being driven by an electric motor.

In addition, means other than a gearbelt can be used to couple the tape drive assembly to the tape transfer assembly. For example, the tape drive and tape transfer assemblies could be driven by separate motors, operation of the motors being synchronized by a programmable controller.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. For example, it should be obvious that the slider guide may be formed as a monolithic piece or may be an assembly having two or more parts. Therefore it is intended that the invention not be limited to the particular embodiment disclosed as the best mode contemplated for carrying out this invention, but that the invention will include all embodiments falling within the scope of the appended claims.

What is claimed is:

1. An apparatus comprising a tape feed assembly, a tape transfer assembly, and means for coupling said tape feed assembly to said tape transfer assembly, wherein:

said tape feed assembly comprises first and second nip rollers arranged to form a nip therebetween, said first nip roller comprising a first peripheral groove and said second nip roller comprising a second peripheral groove aligned with said first peripheral groove, opposing portions of said first and second grooves forming a passageway designed to allow passage of a slider when associated flanges of a zipper tape carrying said slider are passed through said nip; and said tape transfer assembly comprises a plurality of drive rollers and a shelf comprising a longitudinal groove, each of said drive rollers comprising a respective peripheral groove aligned with said longitudinal groove, opposing portions of each drive roller peripheral groove and said longitudinal groove forming a respective passageway designed to allow passage of interlocked parts of said zipper tape but not allow passage of said slider carried by said zipper tape.

2. The apparatus as recited in claim 1, wherein the circumferential surfaces of said first and second nip rollers and said drive rollers are made of silicone.

3. The apparatus as recited in claim 1, wherein said coupling means comprise a belt belted to first and second pulleys.

4. The apparatus as recited in claim 1, further comprising a guide shaped to guide sliders inserted on zipper tape toward said passageway.

5. The apparatus as recited in claim 1, further comprising a respective shaft to which each drive roller is mounted; a respective pulley mounted to each shaft, said pulleys being aligned; respective sets of bearings for supporting each shaft; a pulley mounting plate supporting said bearings; and a belt in contact with each of said pulleys.

6. The apparatus as recited in claim 1, further comprising a fixed support structure; first means for rotatably supporting said drive rollers; and second means for displacing said first means relative to said support structure in directions generally perpendicular to said shelf.

* * * * *